United States Patent [19]

Paxton

[11] Patent Number: 5,039,048

[45] Date of Patent: Aug. 13, 1991

[54] PENNANT CLIP AND METHOD THEREFOR

[76] Inventor: Joseph A. Paxton, 4144 W. Dunlap, Phoenix, Ariz. 85051

[21] Appl. No.: 467,993

[22] Filed: Jan. 22, 1990

[51] Int. Cl.[5] ..... G09F 17/00

[52] U.S. Cl. ..... 248/229; 116/173; 248/316.6

[58] Field of Search ..... 248/316.6, 229; 116/173, 174

[56] References Cited

U.S. PATENT DOCUMENTS

| | | | |
|---|---|---|---|
| 1,338,210 | 4/1920 | Buckley | 116/173 |
| 2,814,455 | 11/1957 | Rainey | 248/316.6 X |
| 3,183,886 | 5/1965 | Moffitt, Jr. | 116/173 |
| 3,505,761 | 4/1970 | Prieur | 248/229 X |
| 3,706,297 | 12/1972 | Voorhees | 116/174 |
| 3,826,223 | 7/1974 | Lingo, Jr. | 116/174 |
| 4,595,163 | 6/1986 | Guggiari | 248/229 |
| 4,799,444 | 1/1989 | Lisowski | 248/316.6 X |

*Primary Examiner*—David L. Talbott
*Attorney, Agent, or Firm*—Harry M. Weiss

[57] ABSTRACT

A device for coupling a pennant to a rod. The device consists of two opposed members. Each member has a semi-circular channel which surrounds and secures the rod when the two members are attached. Also, one member has a cylindrical member extending therefrom, which is inserted through a hole in the pennant and then press fit into a cylindrical slot situated in the other member.

4 Claims, 1 Drawing Sheet

PENNANT CLIP AND METHOD THEREFOR

BACKGROUND OF THE INVENTION

1. Field of Invention

This invention relates generally to devices and methods therefor for attaching a pennant to a rod and in particular, to a device and method therefor into which a rod can be inserted and secured at one end and at the other end a pennant can be attached.

2. Description of the Prior Art

Generally, pennants have a series of holes lining one of their edges. These holes are usually strengthened by grommets. Presently, a rope or metal ring is inserted through the grommets of the pennant and then attached to a rod. To remove the rope or metal rings from the pennant is a tedious procedure.

Therefore, there is a need for a simple, inexpensive device and method therefor for attaching a pennant to a rod which is easy to attach and detach.

SUMMARY OF THE INVENTION

An object of the present invention is to provide a pennant clip and method therefor for attaching a pennant to a rod that is easy to attach and detach.

Another object of the present invention is to provide a pennant clip and method therefor that is rigid.

These and other objects, features and advantages of the present invention, as well as details of the preferred embodiment thereof, will be more fully understood from the following description and drawing.

DESCRIPTION OF THE PREFERRED EMBODIMENT

Figure 1:
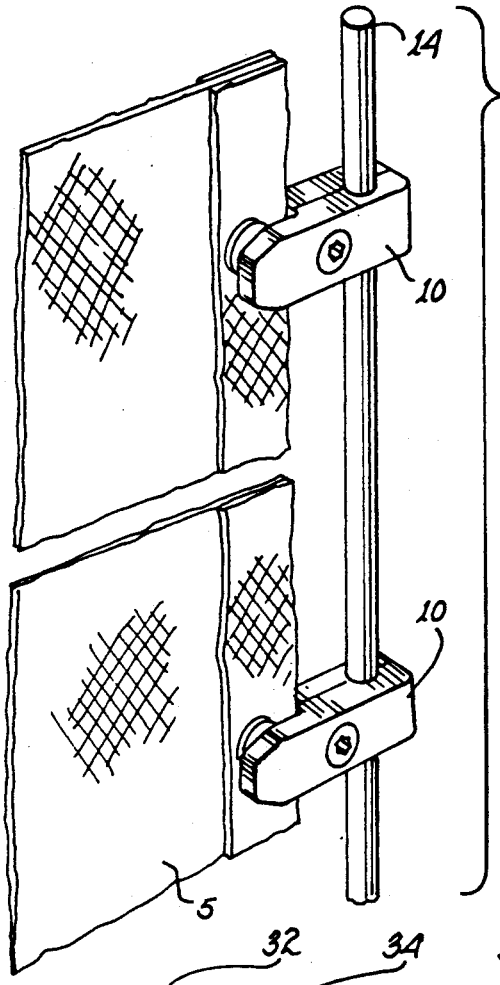
FIG. 1 is a perspective view of pennant clip of the present invention coupled to both a pennant and a rod.
Figure 2:
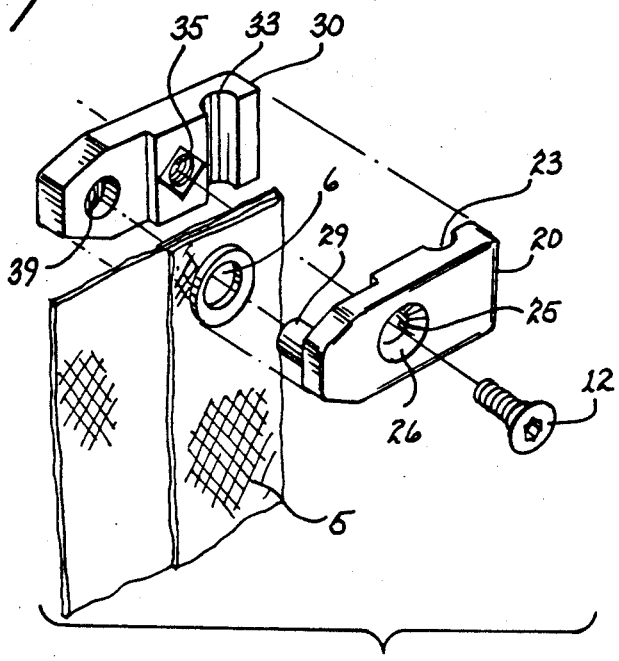
FIG. 2 is an exploded view showing the pennant clip of FIG. 1 and a corner of a pennant.
Figure 4A:
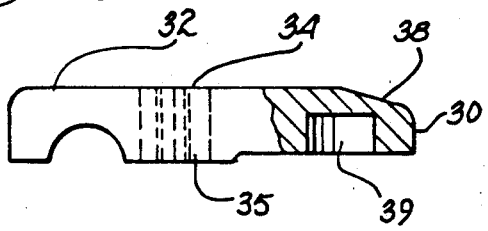
FIG. 4*a* is a side, elevational view of the second member of the pennant clip of FIG. 1.
Figure 3A:
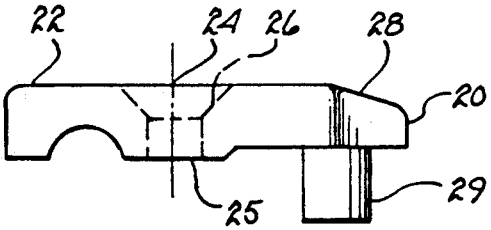
FIG. 3*a* is a side, elevational view of the first member of the pennant clip of FIG. 1.
Figure 4B:
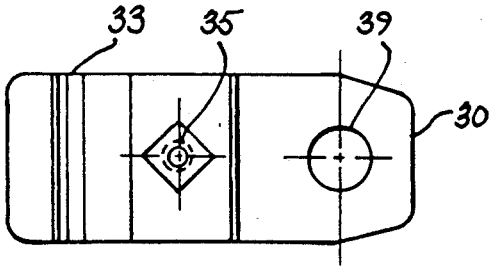
FIG. 4*b* is a top view of the second member of the pennant clip of FIG. 1.
Figure 3B:
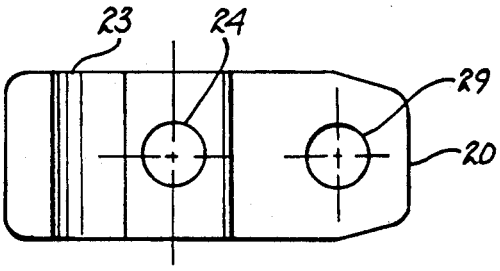
FIG. 3*b* is a top view of the first member of the pennant clip of FIG. 1.

Referring to the drawings, FIGS. 1–4*a,b* show a pennant clip 10 having a first member 20 and a second member 30.

The first member 20 has a first end 22, a middle section 24 and a second end 28. On the inside of the first end 22 is a vertical, semi-circular channel 23 extending therethrough. Preferably, the channel 23 has a radius equal to about ½ the thickness of the first end 22. The middle section 24 has a horizontal hole 25, with a tapered inlet 26, extending completely through the section 24 for receiving the tapered head end of a locking pin 12. The inside of the second end 28 is slightly recessed and has a cylindrical member 29 projecting therefrom.

The second member 30 has a first end 32, a middle section 34 and a second end 38. On the inside of the first end 32 is a vertical, semi-circular channel 33 extending therethrough. Preferably, the channel 33 has a radius equal to about ½ the thickness of the first end 32. The middle section 34 has a threaded, horizontal hole 35 extending completly through the section 34 for receiving the threaded, tail end of the locking pin 12. The inside of the second end 38 is slightly recessed and has a cylindrical slot 39 extending into the second end 38 to a depth of about ½ the thickness of the second end 38. The slot 39 is sized to frictionally engage the outside surface of the cylindrical member 29.

The first member 20 and the second member 30 are identically dimensioned so that when the inside surfaces of these members face each other the channel 23 and the channel 33 align to form a hole for receiving and securing a rod 14. The rod 14 can be made from wood, plastic or metal. Also, cylindrical member 29 aligns with the cylindrical slot 39. The cylindrical member 29 can be inserted through a hole 6 in a pennant 5 (see FIG. 2) and then press fit into the cylindrical slot 39. Lastly, the horizontal hole 25 aligns with the horizontal hole 35. The locking pin 12 is inserted through the horizontal hole 25 and screwed into the horizontal hole 35, locking the first member 20 to the second member 30 and thereby coupling the pennant 5 and the rod 14.

To uncouple the pennant 5 from the rod 14, the locking pin 12 is unscrewed, preferably with an allen wrench, from the first and second members 20 and 30. The rod 14 is then free to be slid out from between the members 20 and 30. By applying a slight force pulling the members 20 and 30 apart the cylindrical member 29 can be removed from the cylindrical slot 39, thereby releasing the pennant 5.

While the invention has been particularly shown and described with reference to a preferred embodiment thereof, it will be understood by those skilled in the art that changes in form and detail may be made therein without departing form the spirit and the scope of the invention.

I claim:

1. A combined pennant and pennant clip for attaching the pennant to a rod, comprising:

a pennant having at least one hole;

said pennant clip comprising a first member having, on its inside, a proximate end with a semi-circular channel extending vertically therethrough and a distal end with an outwardly projecting solid cylindrical member means for inserting through said hole in said pennant and for preventing said pennant to move relative to said pennant clip;

a second member having, on its inside, a proximate end with a semi-circular channel extending vertically therethrough and a distal end with a cylindrical slot sized to frictionally engage said cylindrical member means, said semi-circular channels of said first and second members being used to hold said rod;

means for attaching said first member to said second member recess means are provided on the inside distal end portions of said first and second members for permitting an end portion of said pennant surrounding said hole in said pennant to be inwardly inserted between said first and second members; and said cylindrical slot having a closed end portion, said cylindrical member having an end portion located adjacent to and stopped by said closed end portion of said cylindrical slot.

2. The combined pennant and pennant clip recited in claim 1, wherein said attaching means comprises a locking pin inserted through a hole in both said first and second members.

3. The combined pennant and pennant clip recited in claim 1 wherein said attaching means comprises a locking pin inserted through a hole in both said first and second members outside of said end portion of said pennant.

4. A method for attaching a pennant to a rod, which comprises the steps of;

providing a first member having a proximate end with a semi-circular vertical channel and a distal end a solid cylindrical member projecting therefrom;

providing a second member having a proximate end with a semi-circular vertical channel and a distal end with a cylindrical slot sized to frictionally engage said cylindrical member;

providing said cylindrical slot with a closed end portion, said cylindrical member having an end portion located adjacent to and stopped by said closed end portion of said cylindrical slot;

providing recess means on the inside distal end portions of said first and second members for permitting an end portion of said pennant surrounding said hole in said pennant to be inwardly inserted between said first and second members;

inserting said cylindrical member through a hole in said pennant;

inserting said rod through said semi-circular channel of said first member; and attaching said first member to said second member so that said cylindrical member press fits into said cylindrical slot and said two semi-circular channels align, securing said rod.

* * * * *